United States Patent [19]

Cunningham et al.

[11] 4,185,167

[45] Jan. 22, 1980

[54] SOUND MASKING PACKAGE

[75] Inventors: Donald R. Cunningham, Randolph; James E. Sulewsky, Mendham, both of N.J.

[73] Assignee: Acoustical Design Incorporated, Morristown, N.J.

[21] Appl. No.: 933,024

[22] Filed: Aug. 11, 1978

Related U.S. Application Data

[63] Continuation of Ser. No. 700,595, Jun. 28, 1976, abandoned.

[51] Int. Cl.[2] ..... H04R 3/00

[52] U.S. Cl. ..... 179/1 AA; 179/1 E; 179/1.5 M

[58] Field of Search ..... 179/1 E, 1 P, 1 AA, 179/1 HF, 1.5 M; 325/361

[56] References Cited

U.S. PATENT DOCUMENTS

| | | | |
|---|---|---|---|
| 2,983,790 | 5/1961 | Olson | 179/1 P |
| 2,986,140 | 5/1961 | Gardner et al. | 179/1 AA |
| 3,057,960 | 10/1962 | Kaiser | 179/1 P |
| 3,101,391 | 8/1963 | Tomatis | 179/1 P |
| 3,126,450 | 3/1964 | Neil et al. | 179/1 AT |
| 3,213,851 | 10/1965 | Currea | 179/1 AA |
| 3,229,429 | 1/1966 | Conrad | 52/2 |
| 3,272,198 | 9/1966 | Balkin | 179/1 AA |
| 3,392,240 | 7/1968 | Parkin | 179/1 P |
| 3,541,452 | 11/1970 | DiSesa et al. | 325/361 |
| 3,567,863 | 3/1971 | Morrissey | 179/1 AA |
| 3,826,870 | 3/1970 | Wurm et al. | 179/1 P |
| 3,911,221 | 10/1975 | Wong | 179/1 E |

FOREIGN PATENT DOCUMENTS

| | | | |
|---|---|---|---|
| 446443 | 3/1968 | Switzerland | 179/1 E |
| 659818 | 10/1951 | United Kingdom | 179/1 E |

*Primary Examiner*—Malcolm A. Morrison
*Assistant Examiner*—E. S. Kemeny
*Attorney, Agent, or Firm*—Fleit & Jacobson

[57] ABSTRACT

A self-contained sound masking package including a housing having an interior forming a loudspeaker enclosure in the bottom of which is disposed an electric circuit arranged to be connected to an associated source of electrical power for producing a voltage having a predetermined frequency range within the audible spectrum and with the frequencies at predetermined relative decibel levels, the voltage being applied to a transducer such as a loudspeaker having a coil supported in the housing interior adjacent the top of the housing for introducing an audible sound of the predetermined frequency range and decibel levels into the area surrounding the housing, together with means for connecting a remote signal source to the circuit to provide a supplementary audible output from the loudspeaker into the area and the electric circuit being preferably in the form of a printed circuit board and having filter means which may be selectively activated to provide an audible output from the loudspeaker throughout at least two separate frequency ranges and decibel levels.

3 Claims, 5 Drawing Figures

Fig. 1
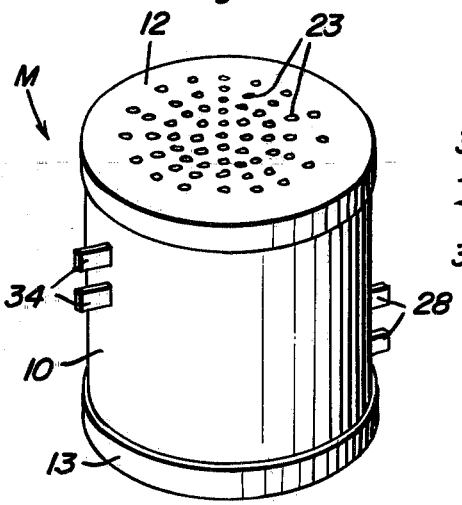
Fig. 2
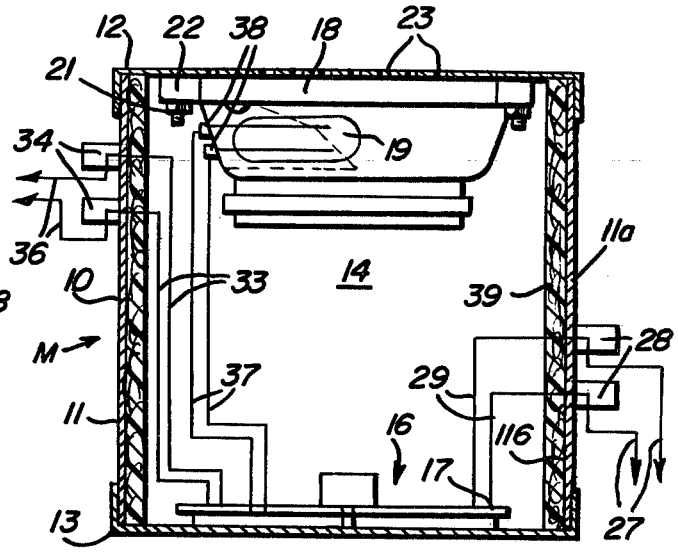
Fig. 4
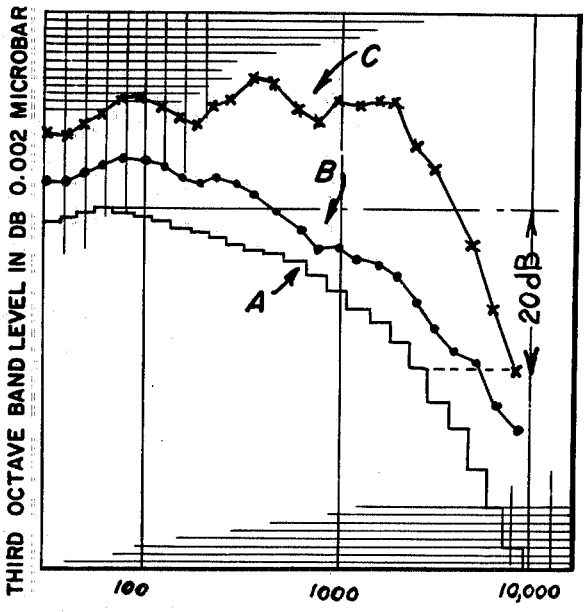
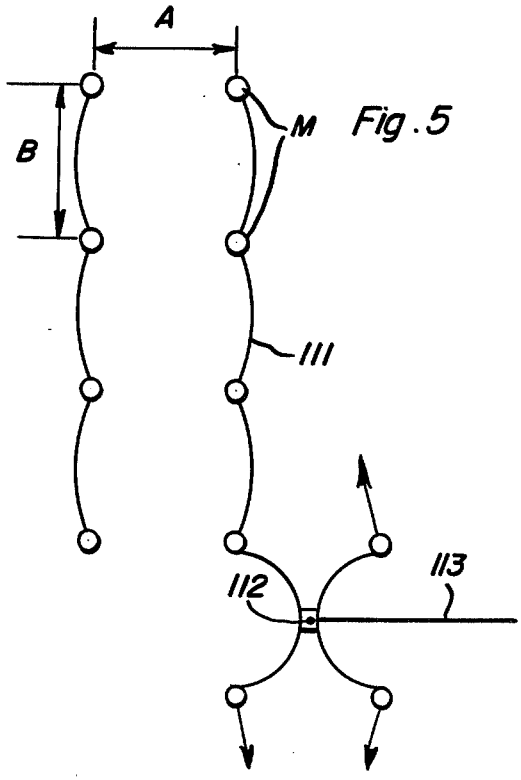
Fig. 5

SOUND MASKING PACKAGE

This is a continuation of application Ser. No. 700,595, filed June 28, 1976, now abandoned.

BACKGROUND OF THE INVENTION

The elimination of unwanted sounds and their distractive influence on the ear of the listener such as an individual in an office, conference room and the like, has been the subject of extensive efforts in the past and while many proposals for the elimination of such unwanted sounds have been made, no completely satisfactory solution has been arrived at to date. Such proposals have included the use of sound-proof construction for an enclosure which due to its cost have been relatively little used or the use of piped-in or canned music in an attempt to condition the environment to reject the unwanted sounds in the area occupied by the listener. However, music itself played continuously may become distracting to the listener or listeners over an extended period of time, particularly if the music is of a type which the listener may not find pleasing.

Recent efforts in the masking of unwanted sounds have been focused on the reaction of the human ear itself and it has been recognized that certain sounds may condition or desensitize the human ear so that it will naturally reject unwanted sound. However, such ear conditioning efforts have not met with any marked degree of success as either the sound generating apparatus has been too bulky and/or expensive or it does not act to reject all unwanted sounds or may in itself become a source of annoyance to the listener.

SUMMARY OF THE INVENTION

Accordingly, a primary object of this invention is to provide a new and novel apparatus for producing a sound which comfortably conditions a human ear to reject all unwanted sounds over any selected period of time.

Another object of this invention is to provide a new and novel self-contained sound masking package which conditions the human ear to reject unwanted sound and which may be inconspicuously and easily installed in an office or a similar enclosure.

A further object of this invention is to provide a new and novel sound masking package which is of unitary construction for the elimination of unwanted sounds on the ear of a listener yet which is virtually silent in operation.

Still another object of this invention is to provide a new and novel self-contained sound masking package for eliminating unwanted sounds on the ear of the listener which may be installed either within an enclosure occupied by the listener or outside the wall of the enclosure in a hidden location.

A still further object of this invention is to provide a new and novel method for conditioning the ear of a listener in a non-annoying, pleasant manner so that by a natural function, the ear of the listener will reject all unwanted sounds.

Still another object of this invention is to provide a new and novel electric circuit for generating virtually inaudible sound for conditioning the ear of a listener to reject unwanted sounds and at the same time may be used for the introduction of an audible signal from a remote source such as music, paging calls, emergency calls or the like into the area occupied by the listener.

This invention further contemplates the provision of a new and novel self-contained masking package which is of simple and inexpensive construction, which applies an audible output to the ear of the listener for eliminating unwanted sound, which may be used as a single unit or in combination with similar units in accordance with the size of the enclosure, which incorporates commercially available component parts, which is readily adjustable for installation within an enclosure or for above-ceiling installation and which may be adjusted to produce an audible output in accordance with the ceiling material.

The objects states above and other related objects in this invention are accomplished by the provision of a self-contained sound masking package including a housing having a side wall, a bottom wall and a top wall defining an interior in which is supported adjacent the bottom wall an electric circuit for continuously producing a voltage having a predetermined frequency range extending throughout the audible spectrum with the various frequencies at predetermined relative decibel levels. A transducer such as a loudspeaker having a coil is also mounted in the enclosure adjacent the top wall, the loudspeaker coil being connected to the output of the electric circuit for applying the output voltage from the circuit to the coil to produce an audible sound having the predetermined frequency range at predetermined relative decibel levels, the electric circuit being connected to an associated source of electrical power and including selectively activated filter means for varying the output voltage in accordance with the area of installation of the package.

BRIEF DESCRIPTION OF THE DRAWINGS

FIG. 1 is a perspective view of the masking package of the invention;

FIG. 2 is a view similar to FIG. 1 with the housing broken away to show the interior of the housing;

FIG. 4 is a chart illustrating the output signal curves of the invention; and FIG. 5 is a connection diagram for the installation of a plurality of masking packages of the type shown in FIG. 1.

DESCRIPTION OF THE PREFERRED EMBODIMENT

Figure 3:
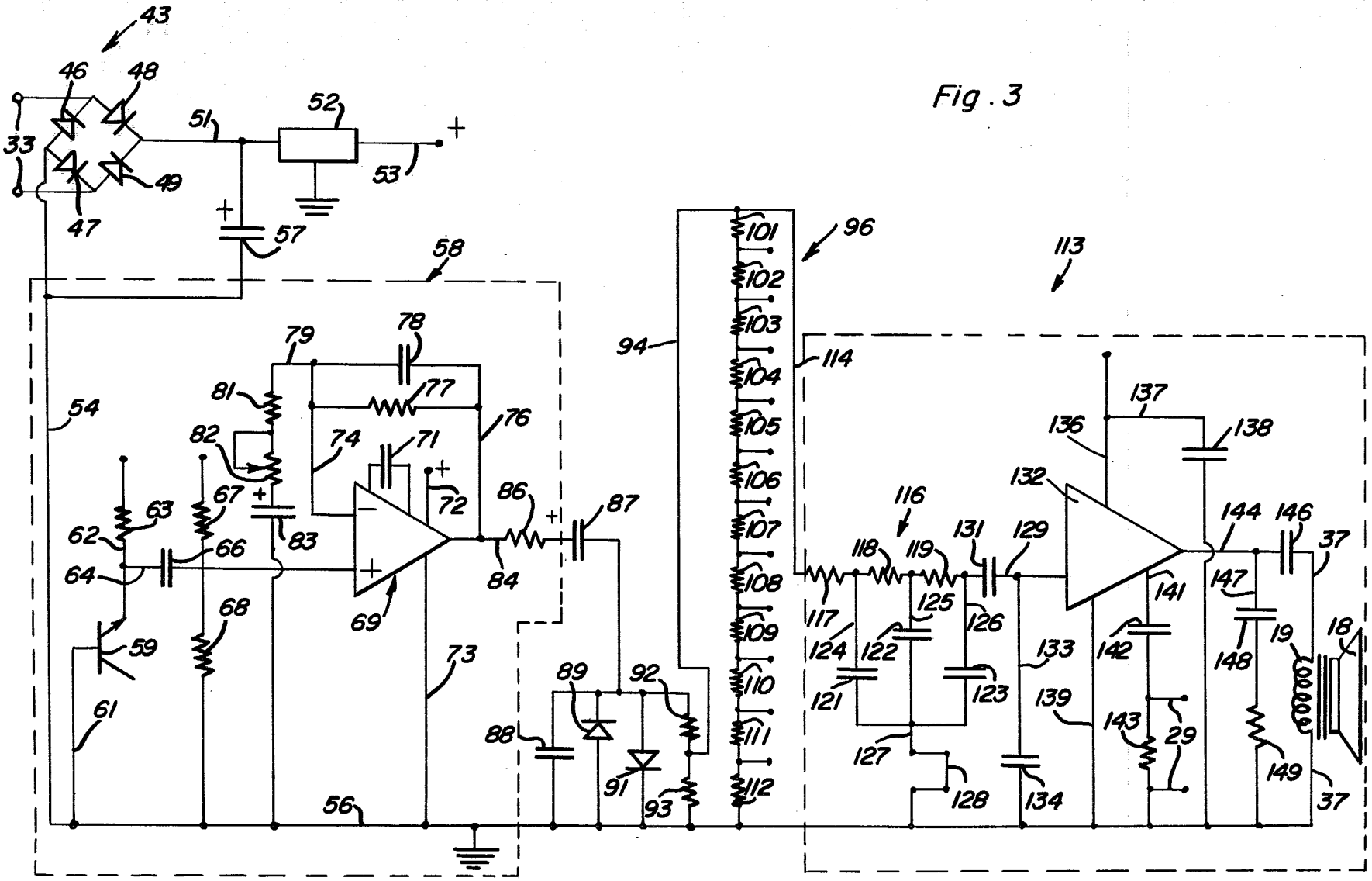
FIG. 3 is a schematic wiring diagram of the electric circuit of the invention.

Referring now to the drawings and to FIG. 2 in particular, there is shown a self-contained sound masking package constructed in accordance with the invention and designated generally by the letter "M." The masking package M includes a housing 10 preferably of cylindrical shape and having a side wall 11, a top wall 12 and a bottom wall 13 defining an interior 14. The housing 11 is preferably formed of a suitable rigid material such as sheet metal or the like and by way of example may have a diameter of approximately 6" and a height of approximately 6", so as to be readily installed in an inconspicuous manner within an enclosure such as an office or the like.

As shown best in FIG. 2, an electric circuit constructed in accordance with the invention and designated generally by the numeral 16 is suitably supported within the interior 14 of the housing 11 adjacent the bottom wall 13 and in substantially parallel relationship therewith. The electric circuit 16 is preferably in the form of a printed circuit board 17, the components and interconnecting conductors being suitably arranged on the printed circuit board as shown in FIG. 3 and as will be explained hereafter.

The masking package M also includes a transducer such as a loudspeaker 18 having a coil 19 disposed within the housing interior 14 adjacent the upper wall 12. The loudspeaker 18 may be of any conventional type and is mounted on the underside of the housing top wall 12 by suitable means such as mounting bolts 21 or the like using spacers 22. As shown in FIG. 2, the housing top wall 12 is preferably provided with a plurality of perforations 23 through which the audible sounds produced by the loudspeaker 18 are introduced into the area surrounding the masking package M.

In the preferred embodiment, the circuit 16 is arranged to be connected to a remote signal source (not shown) such as a musical transcription, a paging system or an emergency call system. Connection of the circuit 16 to such a remote signal source may be accomplished through external conductors 27 connected at one end to the remote signal source and at the other end to a pair of terminals 28 suitably mounted on the outer surface 11*a* of the side wall 11 as shown best in FIG. 2. The terminals 28 are connected by means of a pair of conductors 29 extending within the housing interior 14 to terminals provided on the printed circuit board as will be explained hereinafter.

Means are provided for connecting the electric circuit 16 to an associated source of electric power which, in the illustrated embodiment, includes a pair of conductors 33 connected at one end to the input terminals of the electric circuit as will be described hereinafter and extending upwardly along the inner surface 11*b* of the side wall 11 within the housing interior 14. The conductors 33 extend through the side wall 11 to a pair of terminals 34 suitably mounted on the outer surface 11*a* of the side wall 11. Conductors 36 are provided for connecting the other ends of the conductors 33 at the terminals 34 to the associated source of electric power (not shown) such as a 16 volt AC step-down transformer.

Means are provided for connecting the electric circuit 16 to the loudspeaker coil 19 which, in the illustrated embodiment, includes a pair of conductors 37 connected at one end to the output of the electric circuit 16 and extending upwardly adjacent the inner surface 11*b* of the side wall 11. The other ends of conductors 37 are connected to suitable terminals 38 provided on the coil 19. Preferably, a suitable liner of damping material such as a layer 39 of fibreglass or the like is attached to the inner surface 11*b* of the housing side wall 11 thereby providing an infinite volume effect within the housing interior 14 in the well-known manner.

Referring now to FIG. 3, the electric circuit 16 of the invention is shown schematically , the components and interconnecting conductors being supported in the well-known manner on the printed circuit board 17. As shown in FIG. 3, the circuit 16, which is connected to an associated source of electric power by means of conductors 33, 36 as discussed above, includes a bridge 43 having diodes 46–49 for full-wave rectification of the AC input power to the circuit 16. In the bridge 43, the intersection of diodes 48, 49 are connected by means of conductor 51 to an integrated circuit 52 forming a voltage regulator suitably grounded as shown, the output of which on conductor 53 provides a positive regulated potential source. The positive potential on conductor 51 is preferably 15 volts.

The intersection of diodes 46, 47 in the bridge 43 is connected by means of conductor 54 to a suitable ground represented by grounded conductor 56, conductor 54 being connected to conductor 51 through a capacitor 57. The circuit of FIG. 3 includes a portion shown in broken lines and designated generally by the reference numeral 58 in which a signal voltage of the desired configuration is produced. The circuit portion 58 may be referred to as a "noise generator" and includes a noise source such as a transistor 59 for producing the selected "noise" which is to be processed and distributed into the surrounding area by the masking package M. Any suitable type of noise source 59 may be used such as a diode, a zener diode or the like. The base of transistor 59 is connected to ground by means of conductor 61 and the emitter to the source of positive potential by means of conductor 62 through a resistor 63.

The intersection of the resistor 63 and emitter of transistor 59 is connected by means of conductor 64 through the capacitor 66 to the adjacent sides of resistors 67, 68 the other sides of which are connected to the source of positive potential and the ground 56 respectively. This junction 64 is also connected to a terminal on an integrated circuit designated generally by the numeral 69 which with the component parts incorporated therein constitute a preamplifier for the signal emanating from the transistor or noise source 59.

As shown, various terminals of the integrated circuit 69 are connected to a capacitor 71, the source of positive potential by means of conductor 72, to the ground 56 by means of conductor 73 and by means of conductors 74, 76 to the opposite sides of resistor 77 and capacitor 78 arranged in parallel relationship as shown. One side of the capacitor 78 is connected by means of conductor 79 through a resistor 81, a variable resistance 82, and capacitor 83 to the grounded conductor 56 as shown. It should be understood that the variable resistance or potentiometer 82 is utilized to adjust the gain of the pre-amplifier 69 thereby forming level control means.

The output of the integrated circuit or preamplifier 69 is connected by means of conductor 84 through a resistor 86, a capacitor 87 to one side of a set of components arranged in parallel relationship which include a capacitor 88, diodes 89 and 91 arranged in reverse relationship, and resistors 92, 93, the other sides of these components being connected to the grounded conductor 56.

A conductor 94 is connected between resistances 92, 93 at one end and at its other end to a multi-position switch 96 preferably a twelve position switch. The switch 96 is preset in accordance with the conditions of use for the masking package M and thereby forms an attenuator or decibel level control.

A plurality of series connected resistors 101–112 are associated with the switch 96 which may be selectively added or subtracted from the circuit by the selection of the various switch positions. Conductor 94 is connected to one end of the resistors 101–112 and the other end of the resistors 101–112 is connected to the grounded conductor 56. It should be understood that the switch 96 acts as an attenuator in accordance with the amount of resistance introduced into the circuit to thereby permit the preselection of the decibel levels of the output sound produced in the circuit 16.

The output side of the switch 96 is connected to another portion of the circuit shown in broken lines and designated by the reference numeral 113 which provides filtering and amplification of the output signal from the switch 96. More specifically, the output of switch 96 is connected by means of conductor 114 to filter means designated generally by the numeral 116 which includes series connected resistors 117, 118 and 119 and capacitors 121, 122 and 123 arranged in parallel relationship. One side of each of the capacitors 121–123 is connected by means of conductors 124, 125, 126 to the intersections of resistors 117–119 respectively as shown and the other side of each of the capacitors 121–123 is connected in common to a conductor 127 connected through a jumper or switch 128 to the grounded conductor 56 by means of which the capacitors 121–123 may be added to or subtracted from the circuit.

The output of the filter means 116 is connected by means of conductor 129 through a capacitor 131 to a terminal on an integrated circuit 132 comprising an audio power amplifier, conductor 129 also being connected by means of a conductor 133 through a capacitor 134 to the ground 56. The integrated circuit 132 is connected by means of conductor 136 to the source of positive potential and by conductor 137 through capacitor 138 to ground 56. The integrated circuit 132 is also connected by conductor 139 to grounded conductor 56 by conductor 141 through capacitor 142 and resistor 143 to ground 56 and by conductor 144 to one side of coupling capacitor 146, the other side of which is connected to one side of coil 19 of loudspeaker 18, by means of one of the conductors 37. The other side of coil 19 is connected by the other conductor 37 to grounded conductor 56. Conductor 144 is also connected by means of conductor 147 through capacitor 148 and resistor 149 to ground 56. The conductors 29, by means of which the remote signal source is connected to the coil 19 of loudspeaker 18, are connected to conductor 141 across a resistor 143.

In operation of the invention, using a single masking package M installed in an enclosure such as an office or the like, the package is energized from the associated source of electric power through conductors 36 and 33 so that the supplied AC voltage is applied to the bridge 43 and the output DC voltage obtained is applied to the various portions of the circuit of FIG. 3. The signal voltage developed in the noise generator 59 is fed to the preamplifier 69 the gain of which is adjusted by means of the variable resistor 82. The output signal from the preamplifier 69 is conducted by means of conductor 94 through the multi-position switch 96 which functions as an attenuator for the signal thereby permitting the decibel level of the audio output of the loudspeaker 18 to be selected. Such attentuation is accomplished by the selected position of the switch 96 which determines the total resistance introduced into the circuit utilizing resistors 101–112.

The signal is then conducted by means of conductor 114 through filter means 116 which is added to the circuit when the switch 128 is closed and disconnected when the switch 128 is opened. The output voltage from the filter means 116 is then amplified in audio power amplifier 132 and the amplified signal voltage is applied to the loudspeaker coil 19 through conductors 37 to transmit an audible output through the housing perforated top wall 12 in the area surrounding the masking package M.

The audio output signal from the loudspeaker 18 corresponds selectively to the curves A–C in FIG. 4 wherein the audio signal has a frequency range throughout the audible spectrum, namely from approximately 0 to 10,000 hertz with the decibel level of each frequency of the audio signal at a predetermined level throughout the audible spectrum for each of the curves. It should be understood that the frequency bands or curves A, B represents the output signal from the loudspeaker 18 with the switch 128 in the closed position and with the masking package M installed within an enclosure or with the package M installed above the ceiling of the enclosure where the ceiling is constructed of 1" nubby fibreglass material respectively.

When the masking package M is installed above a ceiling panel in an enclosure, the audio output signal from the loudspeaker 18 is varied for such an above-ceiling installation. This adjustment is accomplished by modifying the filtering action of filter means 116. This is accomplished by moving switch 128 into the open position so that the audio signal from the loudspeaker 18 corresponds to curve C in FIG. 4 where the ceiling material is of ⅝", 0.95 psf mineral fiber wherein the signal has a range of frequencies extending throughout the same audible spectrum as curves A, B but with the decibel level for each frequency having the values as shown in curve C.

Wherein the masking package is to be used in the area substantially larger than the typical office enclosure, a plurality of masking packages M may be connected together for simultaneous operation, such an arrangement for a plurality of masking packages being shown in FIG. 5. Adequate sound masking coverage is obtained when the masking packages M are spaced apart within the range of between 16 to 20 feet, the masking packages being interconnected by suitable conductors 111 and supplied with power through a junction box 112 suitably connected to a source of electric power by conductors 113.

What is claimed is:

1. A self-contained sound masking package comprising, in combination, a closed housing having an acoustically permeable top wall, a side wall, and a bottom wall, defining an interior, circuit means formed as a printed circuit board with an electric circuit arranged on said printed circuit board disposed within said housing interior including means for supporting said circuit means adjacent said bottom wall in parallel relationship therewith for producing a plurality of signal voltages having frequencies at predetermined relative decibel levels, said levels thereby forming at least two selectable spectrums having respective frequencies at different decibel levels, switch means connected to said electric circuit for selecting one of said spectrums, a loudspeaker having a speaker cone and a coil and wherein said signal voltages are applied to said loudspeaker coil by said connecting means disposed within said housing including means for supporting said loudspeaker adjacent said acoustically permeable top wall and being directed outwardly for introducing an audio output signal into the area surrounding said housing, sound damping material affixed to the inner surface of said side wall, means for connecting said circuit means to an associated source of electric power, means for connecting the output of said circuit means to said loudspeaker for applying the plurality of signal voltages from said circuit means to said loudspeaker to produce said audio output signal within said audible frequency range and with the frequencies in said audible frequency range at said predetermined relative decibel levels, level control means for adjusting the level of said audio output signal, and means for connecting an associated remote signal source to said circuit means for applying said remote signal to said loudspeaker to provide an audio output signal corresponding to said remote signal in addition to the audio signal produced by said circuit means into the area surrounding the housing.

2. A masking package in accordance with claim 1 wherein said speaker cone is directed outwardly.

3. A masking package in accordance with claim 2 wherein said means for connecting said circuit means to said loudspeaker coil comprise a pair of conductors connected at opposite ends to said circuit means and said loudspeaker coil respectively and extending adjacent the inner surface of said housing within said housing interior.

* * * * *

REEXAMINATION CERTIFICATE (1296th)

United States Patent [19] [11] B1 4,185,167

Cunningham et al. [45] Certificate Issued Jun. 5, 1990

[54] SOUND MASKING PACKAGE

[75] Inventors: Donald R. Cunningham, Randolph; James E. Sulewsky, Mendham, both of N.J.

[73] Assignee: Acoustical Design Incorporated

Reexamination Request:
No. 90/001,780, Jun. 5, 1989

Reexamination Certificate for:

| | |
|---|---|
| Patent No.: | **4,185,167** |
| Issued: | **Jan. 22, 1980** |
| Appl. No.: | **933,024** |
| Filed: | **Aug. 11, 1978** |

Related U.S. Application Data

[63] Continuation of Ser. No. 700,595, Jun. 28, 1976, abandoned.

[51] Int. Cl.[5] ..... H04R 3/00
[52] U.S. Cl. ..... 381/73.1
[58] Field of Search ..... 333/28 T; 381/103, 98, 381/73.1

[56] References Cited

U.S. PATENT DOCUMENTS

| | | | |
|---|---|---|---|
| 2,983,790 | 5/1961 | Olson . | |
| 2,986,140 | 5/1961 | Gardner et al. | 600/28 |
| 3,057,960 | 10/1962 | Kaiser | 381/94 |
| 3,101,391 | 8/1963 | Tomatis . | |
| 3,126,450 | 3/1964 | Neil et al. | 381/75 |
| 3,213,851 | 10/1965 | Currea | 600/28 |
| 3,229,429 | 1/1966 | Conrad | 181/198 X |
| 3,272,198 | 9/1966 | Balkin | 600/28 |
| 3,392,240 | 7/1968 | Parkin | 381/63 |
| 3,541,452 | 11/1970 | Disesa et al. | 455/157 |
| 3,567,863 | 3/1971 | Morrissey | 381/73.1 X |
| 3,750,044 | 7/1973 | Stanley | 333/28 T |
| 3,752,928 | 8/1973 | Flickinger | 381/103 |
| 3,803,359 | 4/1974 | Corderman | 333/28 T |
| 3,826,870 | 7/1974 | Wurm et al. | 381/71 |
| 3,909,618 | 9/1975 | Fujii et al. . | |
| 3,911,221 | 10/1975 | Wong | 381/188 |
| 3,980,827 | 12/1976 | Sepmeyer et al. . | |
| 4,024,535 | 5/1977 | Goldstein . | |
| 4,052,564 | 10/1977 | Propst et al. . | |
| 4,059,726 | 11/1977 | Watters et al. . | |

FOREIGN PATENT DOCUMENTS

| | | |
|---|---|---|
| 446443 | 3/1968 | Switzerland . |
| 659818 | 10/1951 | United Kingdom . |

*Primary Examiner*—Forester W. Isen

[57] ABSTRACT

A self-contained sound masking package including a housing having an interior forming a loudspeaker enclosure in the bottom of which is disposed an electric circuit arranged to be connected to an associated source of electrical power for producing a voltage having a predetermined frequency range within the audible spectrum and with the frequencies at predetermined relative decibel levels, the voltage being applied to a transducer such as a loudspeaker having a coil supported in the housing interior adjacent the top of the housing for introducing an audible sound of the predetermined frequency range and decibel levels into the area surrounding the housing, together with means for connecting a remote signal source to the circuit to provide a supplementary audible output from the loudspeaker into the area and the electric circuit being preferably in the form of a printed circuit board and having filter means which may be selectively activated to provide an audible output from the loudspeaker throughout at least two separate frequency ranges and decibel levels.

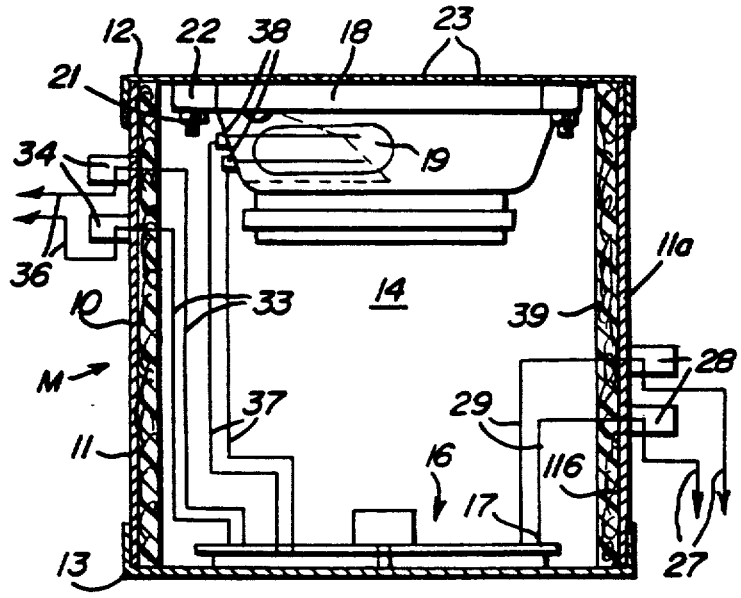

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2 and 3, dependent on an amended claim, are determined to be patentable.

1. A self-contained sound masking package comprising, in combination, a closed housing having an acoustically permeable top wall, a side wall, and a bottom wall, defining an interior, circuit means formed as a printed circuit board with an electric circuit arranged on said printed circuit board disposed within said housing interior including means for supporting said circuit means adjacent said bottom wall in parallel relationship therewith for producing a plurality of signal voltages having frequencies at predetermined relative decibel levels, said levels thereby forming at least two selectable spectrums having respective frequencies at different decibel levels, switch means connected to said electric circuit for selecting one of said spectrums, a loudspeaker having a speaker cone and a coil [and wherein said signal voltages are applied to said loudspeaker coil by said connecting means] disposed within said housing including means for supporting said loudspeaker adjacent said acoustically permeable top wall and being directed outwardly for introducing an audio output signal into the area surrounding said housing, sound damping material affixed to the inner surface of said side wall, means for connecting said circuit means to an associated source of electric power, means for connecting the output of said circuit means to said loudspeaker for applying the plurality of signal voltages from said circuit means to said loudspeaker *coil* to produce said audio output signal within said audible frequency range and with the frequencies in said audible frequency range at said predetermined relative decibel levels, level control means for adjusting the level of said audio output signal, and means for connecting an associated remote signal source to said circuit means for applying said remote signal to said loudspeaker to provide an audio output signal corresponding to said remote signal in addition to the audio signal produced by said circuit means into the area surrounding the housing.

* * * * *